US006039590A

United States Patent [19]

Kunishi

[11] Patent Number: 6,039,590

[45] Date of Patent: Mar. 21, 2000

[54] ELECTRICAL CONNECTOR WITH RELATIVELY MOVABLE TWO-PART HOUSING

[75] Inventor: Shinsuke Kunishi, Hadano, Japan

[73] Assignee: Molex Incorporated, Lisle, Ill.

[21] Appl. No.: 08/915,550

[22] Filed: Aug. 13, 1997

[30] Foreign Application Priority Data

Feb. 14, 1997 [JP] Japan ..... 9-047208

[51] Int. Cl.[7] ..... H01R 13/64

[52] U.S. Cl. ..... 439/247; 439/79

[58] Field of Search ..... 439/79, 80, 247, 439/248

[56] References Cited

U.S. PATENT DOCUMENTS

| | | | |
|---|---|---|---|
| 3,989,331 | 11/1976 | Hanlon | 339/17 CF |
| 4,334,732 | 6/1982 | Roeschlein et al. | 439/248 |
| 4,351,582 | 9/1982 | Emerson et al. | 339/97 R |
| 4,379,611 | 4/1983 | Foege et al. | 339/217 S |
| 4,645,279 | 2/1987 | Grabbe et al. | 339/17 CF |
| 4,687,278 | 8/1987 | Grabbe et al. | 439/842 |
| 4,720,277 | 1/1988 | Sakamoto | 439/842 |
| 4,721,484 | 1/1988 | Sakamoto et al. | 439/842 |
| 4,722,704 | 2/1988 | VanDerStuyf et al. | 439/851 |
| 4,738,631 | 4/1988 | Takahashi et al. | 439/248 |
| 4,773,877 | 9/1988 | Kruger et al. | 439/482 |
| 4,815,982 | 3/1989 | Sadigh-Behzadi | 439/82 |
| 4,874,338 | 10/1989 | Bakermans | 439/851 |
| 4,907,990 | 3/1990 | Bertho et al. | 439/851 |
| 4,932,893 | 6/1990 | Rudoy | 439/395 |
| 4,941,836 | 7/1990 | Bormuth | 439/247 |
| 5,112,235 | 5/1992 | Enomoto et al. | 439/83 |
| 5,201,663 | 4/1993 | Kikuchi et al. | 439/248 |
| 5,306,169 | 4/1994 | Fukushima et al. | 439/248 |
| 5,324,215 | 6/1994 | Walkup et al. | 439/857 |

*Primary Examiner*—Paula Bradley
*Assistant Examiner*—Katrina Davis
*Attorney, Agent, or Firm*—Stephen Z. Weiss

[57] ABSTRACT

An electrical connector includes a dielectric housing having a first housing part and a second housing part, with the housing parts being movable relative to each other. At least one terminal is mounted between the two housing parts. The terminal includes a termination end secured in the first housing part, and a contact arm secured in the second housing part. A first flexible section is disposed between the ends of the terminal to allow for relative movement of the housing parts in a first given direction. A second flexible section is disposed between the first flexible section and the contact arm to allow for relative movement of the housing parts in a second given direction generally transverse to the first given direction. The second flexible section is juxtaposed generally parallel to the contact arm.

19 Claims, 6 Drawing Sheets

ELECTRICAL CONNECTOR WITH RELATIVELY MOVABLE TWO-PART HOUSING

FIELD OF THE INVENTION

This invention generally relates to the art of electrical connectors and, particularly, to an electrical connector which includes a two-part, relatively movable housing, with the relative movement of the housing parts being allowed by the connector terminals.

BACKGROUND OF THE INVENTION

As is well known, two printed circuit boards can be electrically connected by an electrical connector assembly in which a male connector is fixed to one of the printed circuit boards and a female connector is fixed to the other printed circuit board. The female connector has a plurality of female terminals for receiving male pin terminals from the male connector. In an alternative arrangement, an electrical connector may be fixed to one of the printed circuit boards, and a connection edge of the other printed circuit board is inserted into a terminal slot in the fixed electrical connector.

One of the problems with electrical connector assemblies of the character described above is that the solder connections between the terminals and the circuit traces on either printed circuit board are constantly subjected to undue stresses. This can cause the terminals to deform, particularly in miniaturized high density connectors. The forces from the undue stresses actually can cause incomplete connections, even to the point of cracking or peeling-off the solder connections.

In an attempt to solve the problems discussed above, an electrical connector has been proposed in which the dielectric housing is a two-part structure and includes a first or stationary housing part and a second or movable housing part. The first or stationary housing part is fixed to a printed circuit board. The second housing part is movable relative to the fixed housing part and is adapted for receiving a male contact pin or the connection edge of a second printed circuit board. The two housing parts are interconnected by terminals which have flexible sections between contact ends and termination ends thereof to allow for the relative movement between the housing parts. The flexible sections of the terminals, thereby, absorb stresses placed on the housing parts which would otherwise cause deformation or damage to the terminals and/or the solder connections of the terminals to the printed circuit board(s). An example of a two-part housing having flexible terminals interconnecting the housing parts is shown in U.S. Pat. No. 5,112,235, dated May 12, 1992 and assigned to the assignee of the present invention. In that patent, the flexible sections of the terminals are generally U-shaped.

Although "compliant connectors" of the type shown in the above-referenced U.S. patent have been used satisfactory for many uses, there are applications where additional flexibility is required in an omni-directional context. The present invention is directed to satisfying this need and further solving the problems discussed above.

SUMMARY OF THE INVENTION

An object, therefore, of the present invention is to provide an electrical connector of the two-part housing type which has improved flexibility provided by the terminals which interconnect the two housing parts.

In the exemplary embodiment of the invention, the connector includes a dielectric housing having a first housing part and a second housing part. The housing parts are movable relative to each other. At least one terminal is mounted between the two housing parts. The terminal includes a termination end secured in the first housing part and a contact arm secured in the second housing part. A first flexible section is disposed between the termination and contact ends of the terminal to allow for relative movement of the housing parts in a first given direction. A second flexible section is disposed between the first flexible section and the contact arm to allow for relative movement of the housing parts in a second given direction generally transverse to the first given direction. The second flexible section is juxtaposed with the contact arm.

As disclosed herein, the first housing part is adapted for mounting on a printed circuit board. The termination end of the terminal is formed by a tail section projecting from the first housing part for connection to an appropriate circuit trace on the printed circuit board. The second housing part has a receptacle for receiving an edge of a second printed circuit board. The contact arm has a contact portion for engaging an appropriate circuit trace on one side of the second printed circuit board. Preferably, a pair of the terminals have contact arms and respective contact portions on opposite sides of the receptacle for engaging appropriate circuit traces on opposite sides of the second printed circuit board. Still further, the connector is disclosed herein as an elongated connector, with a plurality of the pairs of terminals spaced longitudinally thereof.

The terminals are disclosed herein as stamped and formed structures from sheet metal material. The material of the first and second flexible sections lie in different, transverse planes. The second flexible section is provided by a cantilevered arm generally parallel to the contact arm, and the material of the contact arm lies in a plane generally parallel to the material of the cantilevered arm.

Other features of the invention include a stiffening section disposed between the first flexible section and the second flexible section. A second stiffening section is disposed between the second flexible section and the contact arm. Different terminals are disclosed herein, with the first flexible section being generally U-shaped in some of the terminals and generally S-shaped in other of the terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 3:
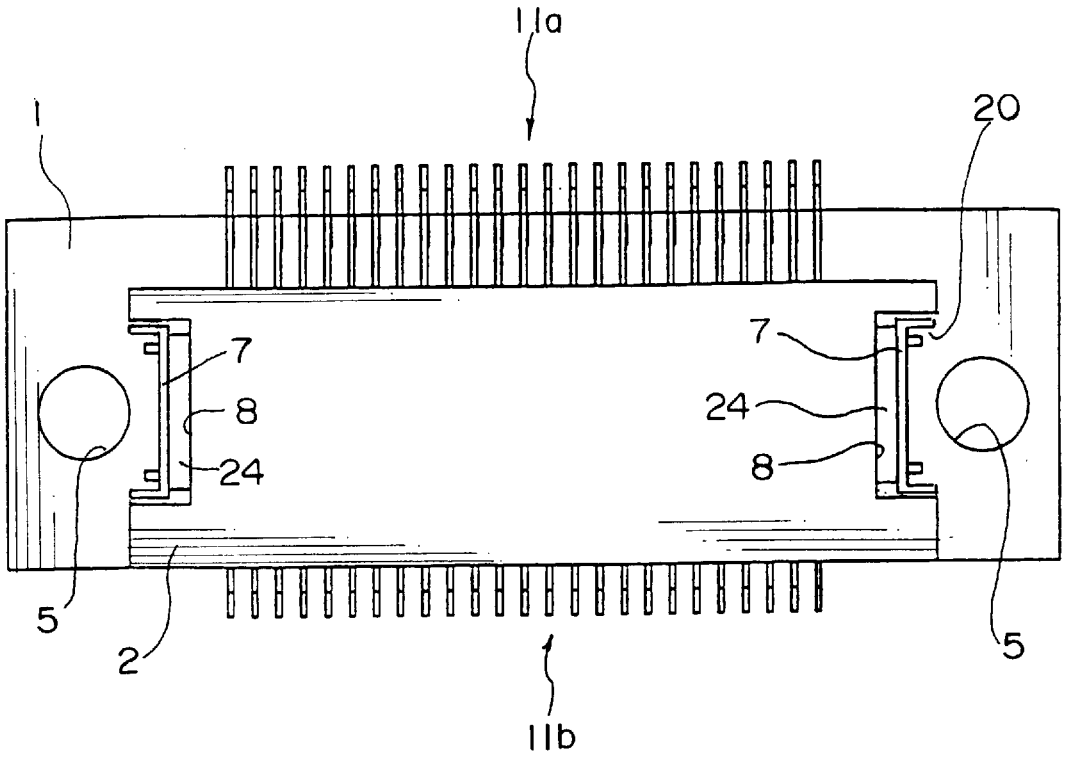
FIG. 3 is a top plan view of the connector.
Figure 4:
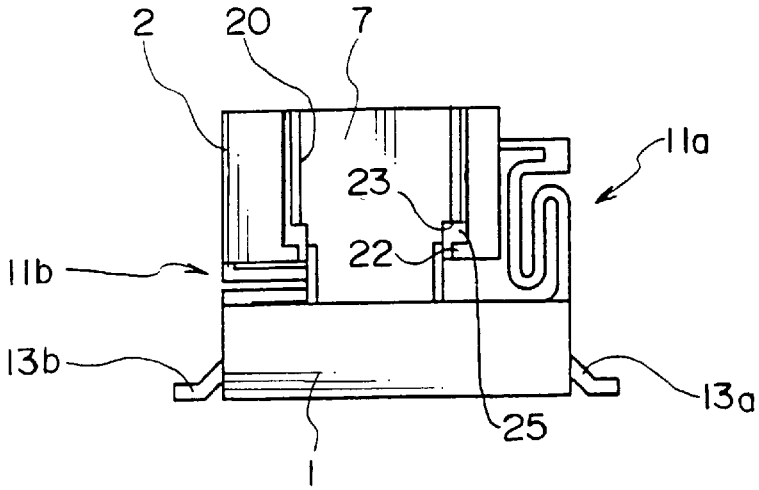
FIG. 4 is a side elevational view of the connector, looking toward the right-hand side of FIGS. 1–3.
Figure 5:
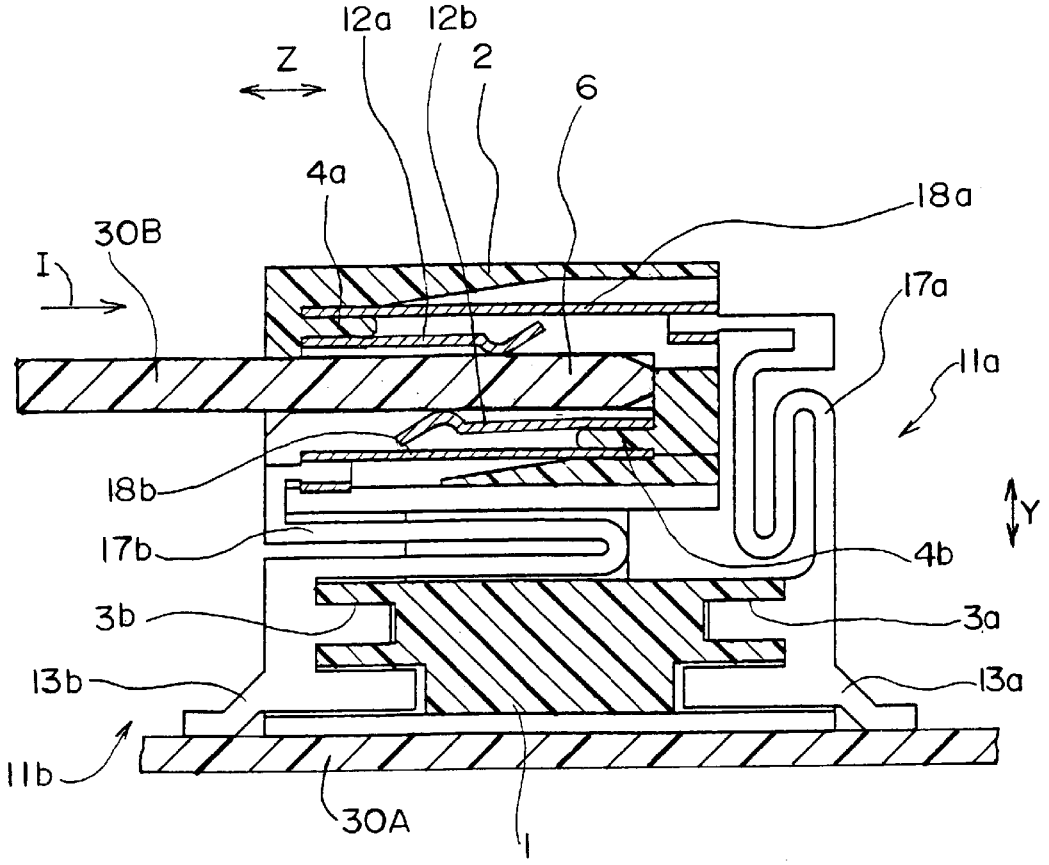
FIG. 5 is a vertical section taken generally along line A—A of FIG. 2.

Referring to the drawings in greater detail, and first to FIGS. 1–5, the concepts of the invention are incorporated in an electrical connector, generally designated "C", which includes a two-part dielectric housing, generally designated "H". The housing is adapted for connecting two printed circuit boards as seen in FIG. 5. The housing includes a first or stationary housing part 1 adapted to be fixed to one of the printed circuit boards 30A (FIG. 5), and a second or movable housing part 2 having a board-insertion slot 6 for receiving the connection edge of a second printed circuit board 30B. The first housing part may have mounting holes 5 for receiving fastening means to mount the first housing part to board 30A.

Figure 1:
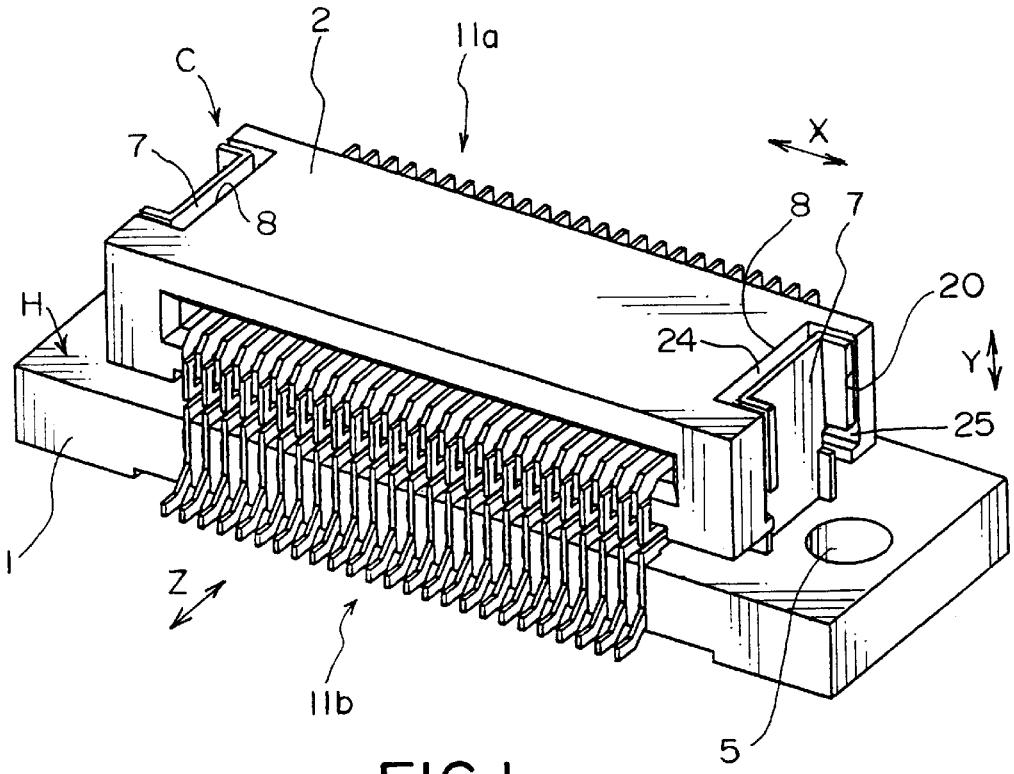
FIG. 1 is a perspective view of an electrical connector embodying the concepts of the present invention.
Figure 2:
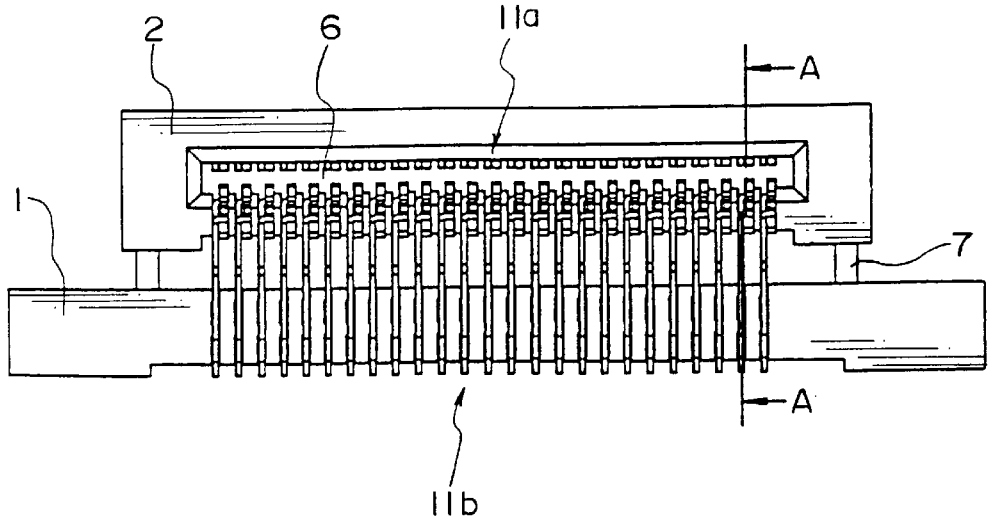
FIG. 2 is a front elevational view of the connector.
Figure 7:
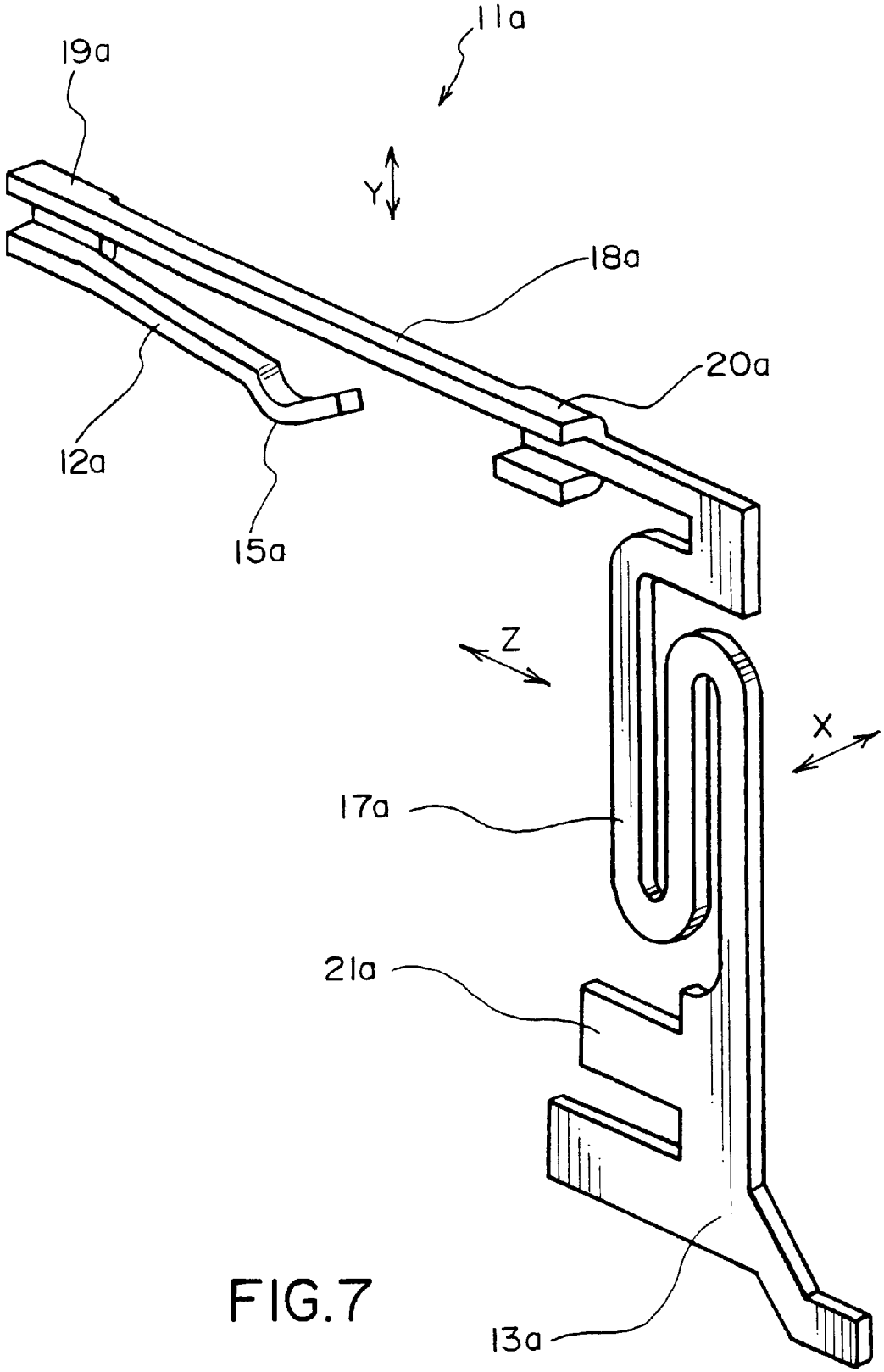
FIG. 7 is a perspective view of one of the "upper" terminals.
Figure 8:
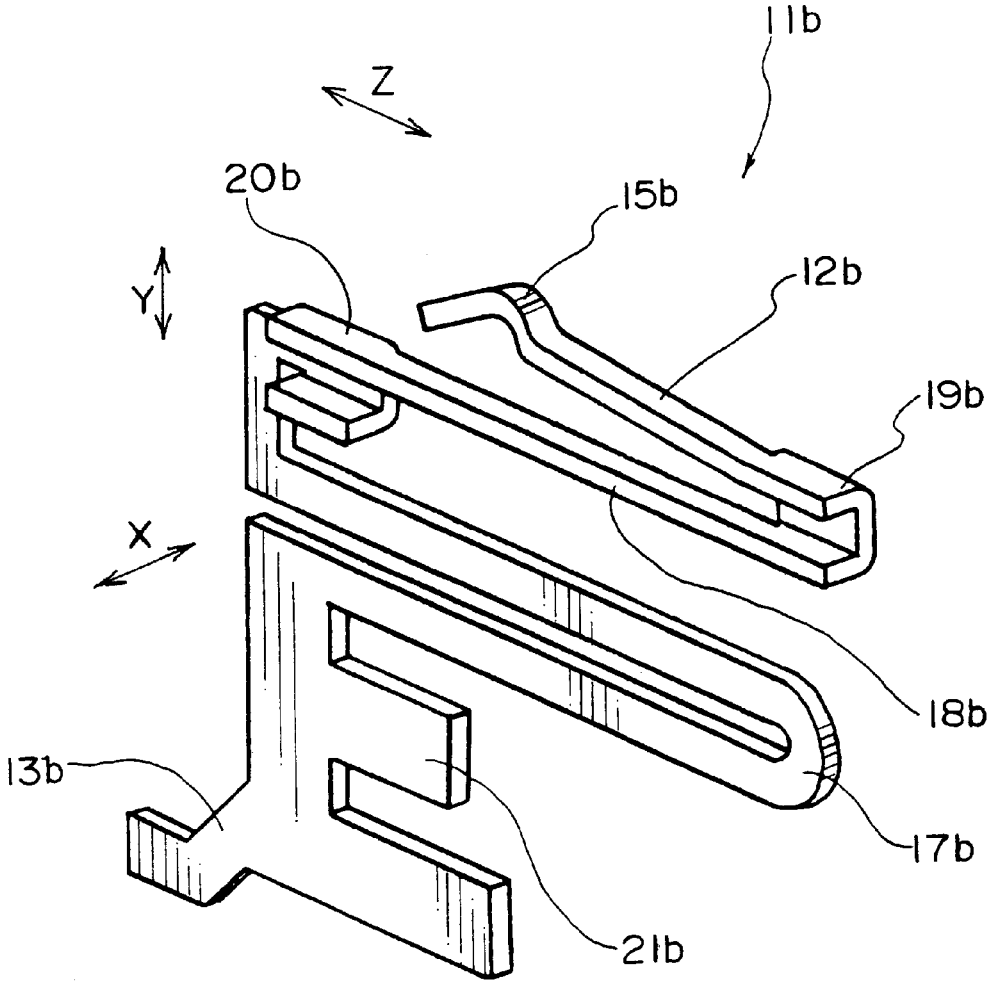
FIG. 8 is a perspective view of one of the "lower" terminals.

A plurality of "upper" terminals 11*a* and a plurality of "lower" terminals 11*b* interconnect the two relatively movable housing parts. Actually, a plurality of pairs of terminals 11*a*, 11*b* are spaced longitudinally of the connector as best seen in FIGS. 1–3. The terminals are stamped and formed from conductive sheet metal material into the given shapes shown in FIGS. 6–8.

More particularly, upper terminal 11*a* includes a contact arm 12*a* in movable housing part 2 and a termination end 13*a* secured in fixed housing part 1. Contact arm 12*a* has a contact portion or contact end 15*a* for engaging an appropriate circuit trace on the top side of printed circuit board 30B. A first flexible section 17*a* is disposed between the ends 13*a* and 15*a* of terminal 11*a* to allow for relative movement of the housing parts in at least a first given direction. A second flexible section 18*a* is disposed between first flexible section 17*a* and contact arm 12*a* to allow for relative movement of the housing parts in a second or vertical direction generally transverse to the direction afforded by first flexible section 17*a*. The second flexible section 18*a* is in juxtaposition or generally parallel to contact arm 12*a*. A stiffening section 19*a* is disposed between contact arm 12*a* and second flexible section 18*a*. Another stiffening section 20*a* is disposed between first and second flexible sections 17*a* and 18*a*, respectively.

As stated above, the terminals are stamped and formed of sheet metal material. As seen most clearly in FIGS. 6 and 7, the material of first flexible section 17*a* lies in a vertical plane, whereas the material of second flexible section 18*a* lies in a generally horizontal plane. Therefore, the material of the two flexible sections lie in different, transverse planes. Still further, it can be seen that the material of contact arm 12*a* lies in a generally horizontal plane, generally parallel to the material of second flexible section 18*a*. Finally, stiffening sections 19*a* and 20*a* are generally U-shaped to provide omni-directional stiffening.

Figure 6:
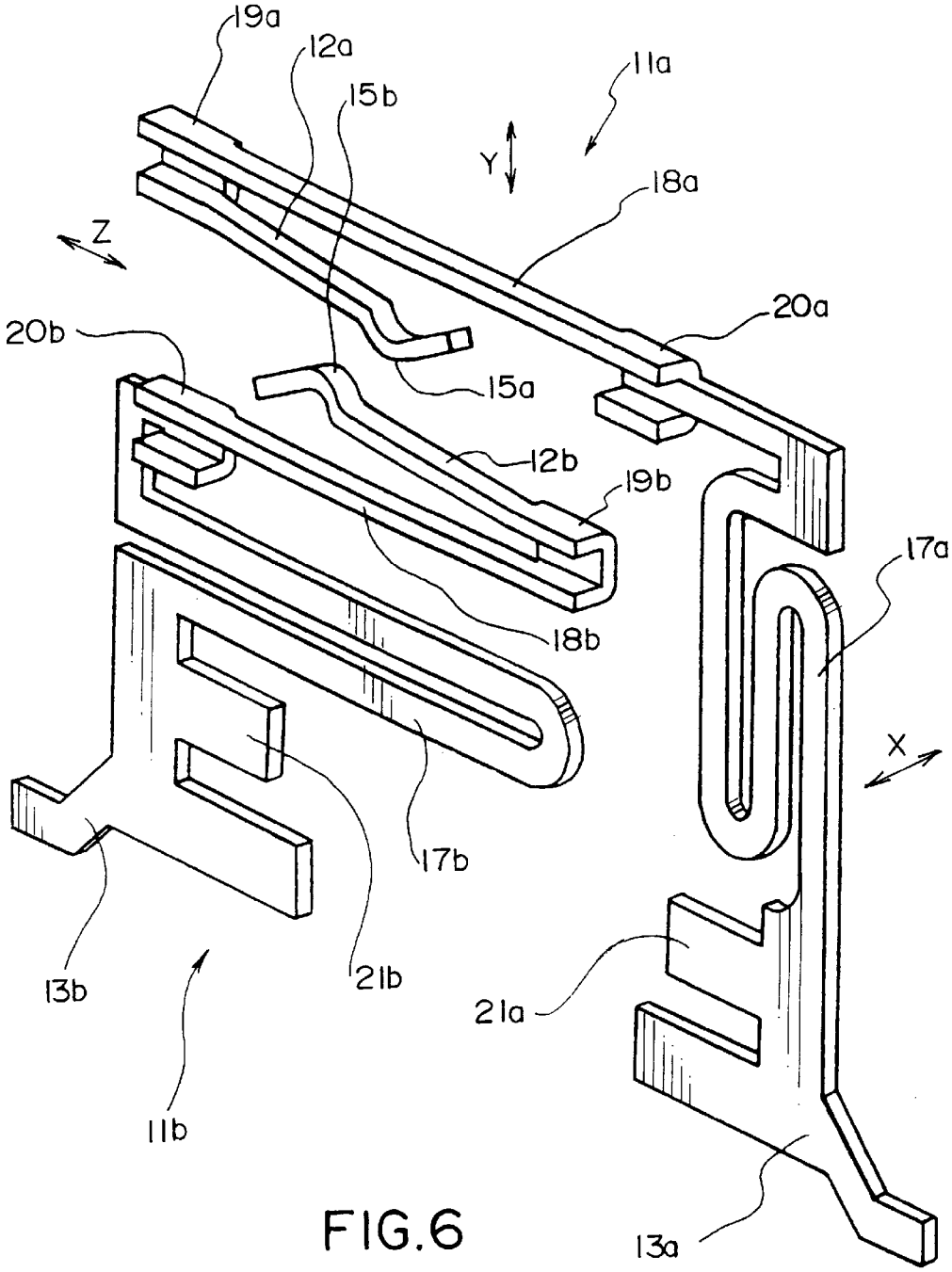
FIG. 6 is a perspective view of one of the pairs of terminals.

From the foregoing detailed description of upper terminal 11*a* in relation to FIG. 6, it can be understood that first flexible section 17*a* provides flexibility in a left-to-right direction (i.e. longitudinally of the connector) as indicated by double-headed arrow "X" which is transverse to the flat plane of the material of the first flexible section. With the first flexible section being generally S-shaped, flexibility also is provided in a front-to-rear direction (i.e. the direction of insertion of printed circuit board 30B) as indicated by double-headed arrow "Z". Second flexible section 18*a* is in the form of a cantilevered arm and, with the material of the cantilevered arm being in a generally horizontal plane, flexibility is provided by the second flexible section in a vertical direction as indicated by double-headed arrow "Y". Therefore, while S-shaped first flexible section 17*a* provides resiliency in both the "X" and "Z" directions, second flexible section 18*a* provides further resiliency in the "Y" direction.

Lower terminal 11*b* is similar to upper terminal 11*a* in that the lower terminal has a contact arm 12*b* in movable housing part 2 and a termination end 13*b* in fixed housing part 2. A first flexible section 17*b* is disposed between the ends of the terminal, and a second flexible section 18*b* is disposed between the first flexible section and contact arm 12*b*. A U-shaped stiffening section 19*b* is disposed between contact arm 12*b* and second flexible section 18*b*, and a U-shaped stiffening section 20*b* is disposed between the first and second flexible sections 17*b* and 18*b*, respectively. Contact arm 12*b* has a contact portion 15*b* for engaging an appropriate circuit trace on a side of printed circuit board 30B opposite contact portion 15*a* of upper terminal 11*a*.

Similar to the structure of upper terminal 11*a*, the sheet metal material of first flexible section 17*b* of lower terminal 11*b* lies in a vertical plane generally transverse to the plane of the material of second flexible section 18*b* which is generally horizontal. Therefore, whereas first flexible section 17*b* of the lower terminal provides flexibility in the "X" direction, second flexible section 18*b* provides flexibility in the "Y" direction. While first flexible section 17*b* is U-shaped, it does not provide flexibility in a straight line direction corresponding to direction "Z", but the U-shaped configuration can "open" and "close" to allow angular relative movement between the housing parts in the "Z" direction.

As stated above, stationary housing part 1 is fixed to printed circuit board 30A as seen in FIG. 5. Tongues 21*a* and 21*b* of upper and lower terminals 11*a* and 11*b*, respectively, are used to fix the terminals in slots 3*a* and 3*b* (FIG. 5) of the stationary housing part. When connector assembly "C" is mounted to printed circuit board 30A, termination ends 13*a* and 13*b* of the terminals provide solder tail sections for soldering to appropriate circuit traces on the top surface of the printed circuit board. The second printed circuit board 30B then can be inserted in the direction of arrow "I" (FIG. 5) into slot 6 in movable housing part 2 whereupon contact portions 15*a* and 15*b* of upper and lower terminals 11*a* and 11*b*, respectively, engage appropriate circuit traces on opposite sides of printed circuit board 30B.

In order to avoid excessive displacement or relative movement between housing parts 1 and 2, supporting braces 7 are fixed to stationary housing part 1 and project upwardly therefrom into guide slots 8 at opposite ends of movable housing part 2. The braces 7 fit somewhat loosely in guide slots 8 to provide a given degree of relative movement between the two housing parts as afforded by terminals 11*a* and 11*b*. In other words, limited horizontal spacing is provided between the braces and the slots as at 20 and 24. As best seen in FIG. 4, vertical spacing 25 is provided between a stop shoulder 22 on the movable housing and a stop shoulder 23 on the respective brace 7. These spaces are determined to allow the amount of desired relative movement between the two relatively movable housing parts. With braces 7 being generally U-shaped (as shown) and fabricated of rigid metal material, the braces prevent any excessive movement beyond the limits afforded by spaces 20, 24 and 25.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector, comprising:

a dielectric housing having a first housing part and a second housing part, the housing parts being movable relative to each other; and at least one terminal mounted between the two housing parts and including a termination end secured in the first housing part, a contact end having a contact arm secured in the second housing part, a first flexible section between said ends to allow for relative movement of the housing parts in a first given direction, a second flexible section between the first flexible section and the contact arm to allow for relative movement of the housing parts in a second given direction generally transverse to said first given direction, the second flexible section being in juxtaposition with the contact arm, and a stiffening section between the second flexible section and the contact arm.

2. The electrical connector of claim 1, including a second stiffening section between the second flexible section and the contact arm.

3. The electrical connector of claim 1 wherein said first flexible section is generally U-shaped.

4. The electrical connector of claim 1 wherein said first flexible section is generally S-shaped.

5. The electrical connector of claim 1 wherein said first housing part is adapted for mounting on a printed circuit board, and said termination end of the terminal comprises a tail section projecting from the first housing part for connection to an appropriate circuit trace on the printed circuit board.

6. The electrical connector of claim 1 wherein said second flexible section comprises a cantilevered arm generally parallel to the contact arm.

7. The electrical connector of claim 6 wherein said terminal is stamped and formed of sheet metal material, and the material of said first and second flexible sections lie in different, transverse planes.

8. The electrical connector of claim 7 wherein the material of said contact arm lies in a plane generally parallel to the material of the cantilevered arm.

9. An electrical connector, comprising:

a dielectric housing having a first housing part and a second housing part, the first and second housing parts being movable relative to each other, the first housing part being adapted for mounting on a first printed circuit board, and the second housing part having a receptacle for receiving an edge of a second printed circuit board; and at least one terminal mounted between the two housing parts and including a termination end secured in the first housing part and having a tail section projecting therefrom for connection to an appropriate circuit trace on the first printed circuit board, a contact end having a contact arm secured in the second housing part and having a contact portion for engaging an appropriate circuit trace on one side of the second printed circuit board, a first flexible section between the ends of the terminal to allow for relative movement of the housing parts in a first given direction, and a second flexible section between the first flexible section and the contact arm to allow for relative movement of the housing parts in a second given direction generally transverse to the first given direction, the second flexible section forming a cantilevered arm juxtaposed with and generally parallel to the contact arm.

10. The electrical connector of claim 9, including a stiffening section between the second flexible section and the contact arm.

11. The electrical connector of claim 9 wherein said first flexible section is generally U-shaped.

12. The electrical connector of claim 9 wherein said first flexible section is generally S-shaped.

13. The electrical connector of claim 9, including a pair of said terminals having contact arms and respective contact portions on opposite sides of the receptacle for engaging appropriate circuit traces on opposite sides of the printed circuit board.

14. The electrical connector of claim 9 wherein said terminal is stamped and formed of sheet metal material, and the material of said first and second flexible sections lie in different, transverse planes.

15. The electrical connector of claim 14 wherein the material of said contact arm lies in a plane generally parallel to the material of the cantilevered arm.

16. The electrical connector of claim 9, including a stiffening section between the first flexible section and the second flexible section.

17. The electrical connector of claim 16, including a second stiffening section between the second flexible section and the contact arm.

18. An electrical connector, comprising:

a dielectric housing having a first housing part and a second housing part, the housing parts being movable relative to each other; and at least one terminal mounted between the two housing parts and including a termination end secured in the first housing part, a contact end having a contact arm secured in the second housing part, a first flexible section between said ends to allow for relative movement of the housing parts in a first given direction, a second flexible section between the first flexible section and the contact arm to allow for relative movement of the housing parts in a second given direction generally transverse to said first given direction, the second flexible section being in juxtaposition with the contact arm, and said second housing part having a receptacle for receiving an edge of a printed circuit board, said contact arm leaving a contact portion for engaging an appropriate circuit trace on one side of the printed circuit board.

19. The electrical connector of claim 18, including a pair of said terminals having contact arms and respective contact portions on opposite sides of the receptacle for engaging appropriate circuit traces on opposite sides of the printed circuit board.

* * * * *